United States Patent [19]

VanderJagt

[11] Patent Number: 5,044,420

[45] Date of Patent: Sep. 3, 1991

[54] VACUUM-ASSISTED, COUNTERGRAVITY CASTING APPARATUS AND METHOD

[75] Inventor: A. Dean VanderJagt, Essexville, Mich.

[73] Assignee: General Motors Corporation, Detroit, Mich.

[21] Appl. No.: 566,523

[22] Filed: Aug. 13, 1990

[51] Int. Cl.[5] ..... B22D 18/06

[52] U.S. Cl. ..... 164/63; 164/255

[58] Field of Search ..... 164/63, 255, 119, 306, 164/256, 66.1

[56] References Cited

U.S. PATENT DOCUMENTS

| | | | |
|---|---|---|---|
| 2,379,401 | 6/1945 | Poulter . | |
| 3,863,706 | 2/1975 | Chandley et al. | 164/255 |
| 3,900,064 | 8/1975 | Chandley et al. . | |
| 4,112,997 | 9/1978 | Chandley | 164/119 |
| 4,340,108 | 7/1982 | Chandley et al. | 164/63 |
| 4,606,396 | 8/1986 | Chandley et al. | 164/255 |
| 4,791,977 | 12/1988 | Chandley | 164/63 |
| 4,809,767 | 3/1989 | Voss et al. | 164/154 |
| 4,828,011 | 5/1989 | Hafer et al. | 164/255 |
| 4,858,672 | 8/1989 | Chandley | 164/63 |
| 4,862,945 | 9/1989 | Greanias et al. | 164/63 |

FOREIGN PATENT DOCUMENTS

| | | | |
|---|---|---|---|
| 996089 | 2/1983 | U.S.S.R. | 164/63 |
| 1215841 | 3/1986 | U.S.S.R. | 164/34 |

*Primary Examiner*—J. Reed Batten, Jr.

*Attorney, Agent, or Firm*—Reising, Ethington, Barnard, Perry & Milton

[57] ABSTRACT

A melt is cast into a gas permeable mold having an upstanding fill sprue that supplies melt to a mold cavity via a lateral ingate. Subambient pressure is applied to the mold fill sprue and to the mold cavity when a lower open end of the sprue and an underlying source of the melt are communicated to urge the melt upwardly to fill the sprue and the mold cavity. Thereafter, the pressure applied to the mold sprue is selectively raised relative to the subambient pressure applied to the mold cavity to cause the melt in the sprue to drain therefrom without siphoning the melt from the melt-filled mold cavity. Pressurized gas can be introduced into the mold sprue as the mold is communicated to the melt source to blow floating slag and other debris away from the region of communication between the sprue lower open end and the source to reduce entry of slag into the mold cavity.

37 Claims, 4 Drawing Sheets

TO VACUUM SOURCE
TO PRESSURE SOURCE
TO VAC SOURCE
134
143
140
145
136
62
88
70
82
94
80
62a
62b
49
142
96
102
146
86
84
90
114
120
100
104
146
132
112
116
64
93
60
14a
110
24b
118
132
93
51
P
93a
124
18a
93a
148
148
48
26
2
40b
28
14b
22
30
130
26
22
P
32
14
41
40a
18
24
43
40
42
47
16
46a
50a
50
45
46
12
12a
10
17
24a

TO VACUUM SOURCE
134
TO PRESSURE SOURCE
136
TO VAC SOURCE
140
62
86
96
146
60
124
100
120
110
146
130
48
P
22
14
22
18
41
43
16
47
50a
24
46
42
45
40
50
12a
17
12
10

VACUUM-ASSISTED, COUNTERGRAVITY CASTING APPARATUS AND METHOD

FIELD OF THE INVENTION

This invention relates to the vacuum-assisted, countergravity casting of a melt into a gas permeable mold and, more particularly, to a method and apparatus for vacuum-assisted, countergravity casting in such a manner as to drain melt from a mold fill sprue after casting without siphoning melt from the melt-filled mold cavities.

BACKGROUND OF THE INVENTION

Apparatus for practicing the vacuum-assisted, countergravity casting process using a gas permeable mold is described in such prior art patents as the Chandley et al U.S. Pat. No. 3,900,064 issued Aug. 19, 1975. U.S. Pat. No. 4,340,108 issued July 20, 1982 and U.S. Pat. No. 4,606,396 issued Aug. 19, 1986.

Typically, the vacuum-assisted, countergravity casting apparatus includes a gas permeable mold, a vacuum chamber disposed about the mold and means for immersing a lower portion of the mold in an underlying pool of the melt while evacuating the vacuum chamber to draw the melt upwardly from the pool into one or more mold cavities of the mold.

In practicing the vacuum-assisted, countergravity casting process to cast a plurality of separate, unconnected parts (i.e., castings), the gas permeable mold comprises a central fill sprue (also referred to as a riser) having an open lower end adapted for immersion in an underlying pool of melt and a plurality of mold cavities each connected in melt flow relation to the fill sprue via a laterally extending ingate therebetween. During casting, the melt is drawn upwardly from the underlying pool through the fill sprue and into the mold cavities via the lateral ingates. Once the mold cavities are filled with the melt, the vacuum chamber/mold are raised to withdraw the sprue open lower end from the pool and the vacuum established in the vacuum chamber is released (i.e., ambient pressure is provided the vacuum chamber) to cause the melt in the fill sprue to drain by gravity back into the underlying pool. Drainage of the fill sprue in this manner improves the overall economies of the vacuum-assisted, countergravity process in that the overall casting cycle time is reduced, a plurality of separate castings unconnected to a central metal sprue are produced (eliminating the need to separate the castings from one another) and less melt is used to produce the castings.

However, in draining the melt from the mold fill sprue in the manner described, siphoning surges are created in the mold cavities as the melt (especially a heavy melt such as molten iron) drains from the sprue open lower end. These siphoning surges are harmful in that some of the melt filling the mold cavities can be siphoned out of the mold cavities and result in the production of defective castings.

Although the Chandley U.S. Pat. No. 4,112,997 issued Sept. 12, 1978 describes a vacuum-assisted, countergravity apparatus and method wherein the melt is drained from the mold fill sprue without siphoning of melt from the mold cavities, the patent requires placement of an apertured stabilizing screen in the ingate between each mold cavity and the fill sprue. The stablizing screens promote early solidification of the melt thereon after the mold cavities are filled to prevent melt drainage from the mold cavities when the vacuum is subsequently released to drain the melt from the fill sprue. However, incorporation of such stabilizing screens into each mold ingate significantly increases the complexity and cost of the gas permeable casting mold and thus adversely affects the economies of the vacuum-assisted, countergravity casting process.

It is an object of the present invention to provide an improved vacuum-assisted, countergravity casting apparatus and method that enable drainage of a mold fill sprue without siphoning melt from melt-filled mold cavities and that eliminate the need for incorporation of stabilizing screens or other additional components into the casting mold.

It is another object of the present invention to provide an improved apparatus and method for the vacuum-assisted, countergravity casting of a melt wherein a positive differential pressure is so established between a mold fill sprue and one or more melt-filled mold cavities after the mold cavities are filled with the melt as to cause the melt in the mold fill sprue to drain therefrom for return to an underlying source without siphoning of the melt from the melt-filled mold cavities.

It is another object of the present invention to provide an improved apparatus and method for the vacuum-assisted, countergravity casting of a melt wherein pressurized gas is introduced into a mold fill sprue as the mold is communicated to an underlying source of the melt for discharge from the sprue toward the melt in a manner to blow impurities and debris floating on the melt away from the melt surface region where the mold is immersed, thereby reducing entry of impurities/debris into the mold.

SUMMARY OF THE INVENTION

The present invention contemplates the vacuum-assisted, countergravity casting of a melt into a gas permeable mold comprising an upstanding fill sprue having an open lower end for communicating with an underlying source of the melt, at least one mold cavity and a lateral ingate connecting the sprue and the mold cavity for supplying the melt from the sprue to the mold cavity. Subambient pressure is applied by suitable means to the mold sprue and to the mold cavity when the sprue open lower end and the melt source are in communication to urge the melt upwardly to fill the sprue and the mold cavity via the lateral ingate. After the mold cavity is filled with the melt, the pressure applied to the sprue is selectively raised by suitable means relative to the subambient pressure applied to the mold cavity (establishing a positive differential pressure therebetween) so as to cause the melt in the mold sprue to drain through the sprue open lower end for return to the melt source without siphoning the melt from the melt-filled mold cavity. The mold is then removed from communication with the underlying melt source.

In one embodiment of the invention, a vacuum box is disposed about the gas permeable mold and includes a first chamber confronting the mold top above the sprue and a second chamber sealingly isolated from the first chamber and confronting the side periphery of the mold. The first chamber is communicated by valve means to a source of subambient pressure and the second chamber is communicated to the same or different source of subambient pressure when the sprue open lower end and the melt source are communicated to apply sufficient subambient pressure to the sprue through the mold top and to the mold cavity through the mold side periphery to urge the melt to fill the sprue and the mold cavity. After the mold cavity is filled with the melt, the valve means is operable to communicate the first chamber to a source of pressure (e.g., ambient pressure, compressed air, compressed inert gas, etc.) to selectively raise the pressure applied to the mold sprue as to cause the melt in the sprue to drain therefrom without siphoning the melt from the melt-filled mold cavity.

In another embodiment of the invention, the lateral ingate of the gas permeable mold descends from the mold sprue toward the mold cavity such that siphoning of the melt from the mold cavity is resisted when the sprue is drained.

The present invention also contemplates the vacuum-assisted, countergravity casting of a melt into a gas permeable mold wherein the mold and an underlying pool of the melt are relatively moved by suitable means to immerse a sprue open lower end in the melt at a surface region thereof. As the mold and the pool are so moved, pressurized gas is introduced into the sprue from a suitable source such that the gas is discharged from the sprue lower open end toward the melt to blow debris/impurities (e.g., slag) floating on the melt away from the surface region as the sprue lower open end is immersed in the melt. This reduces entry of debris/impurities into the mold cavities. The pressurized gas may comprise compressed air or an inert gas that is non-reactive with the melt.

The aforementioned objects and advantages of the present invention will become more readily apparent from the following detailed description taken with the drawings.

DETAILED DESCRIPTION OF THE INVENTION

Figure 1:
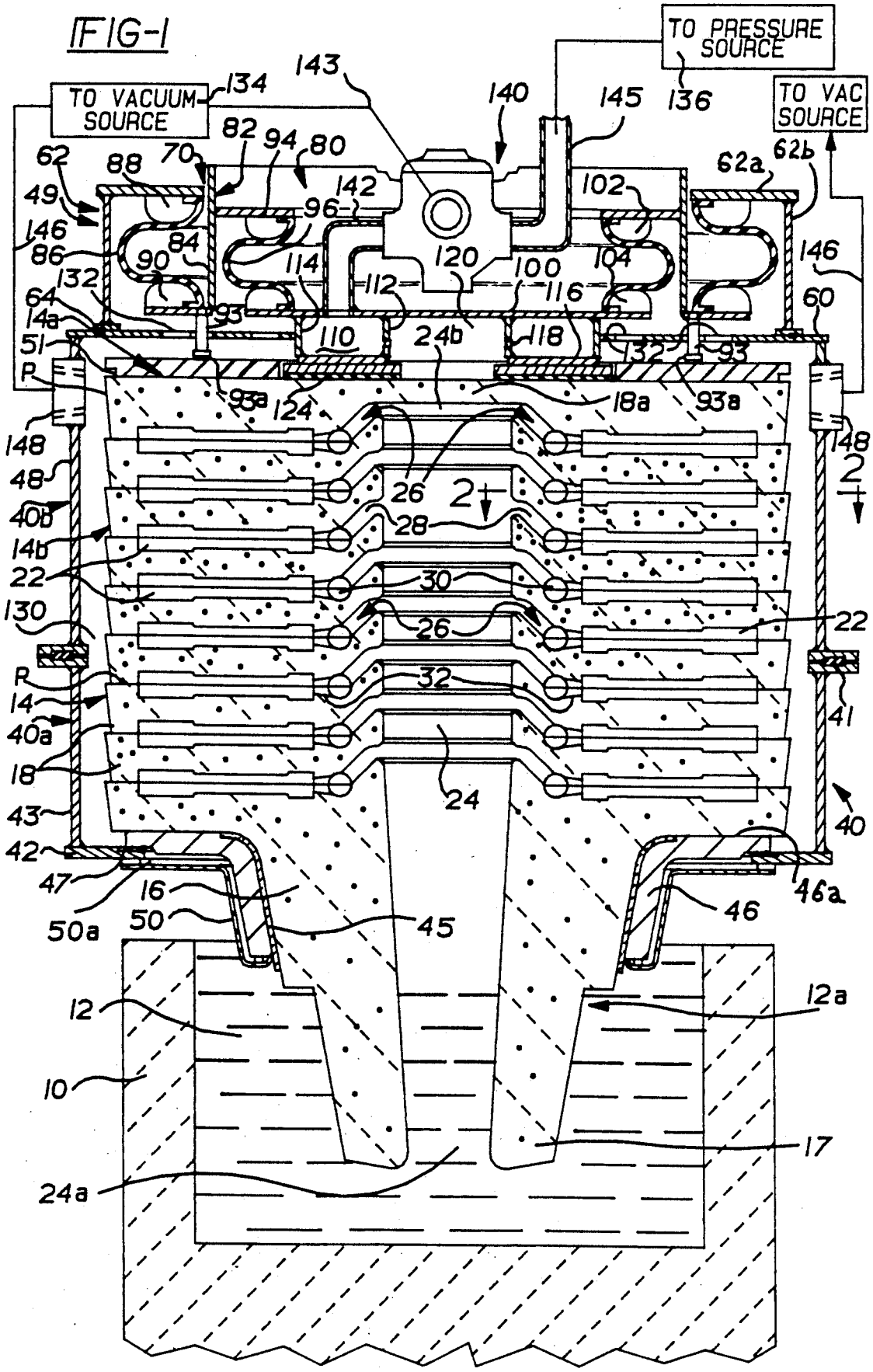
FIG. 1 is a sectioned, side elevational view of a vacuum-assisted, countergravity casting apparatus in accordance with the invention.
Figure 2:
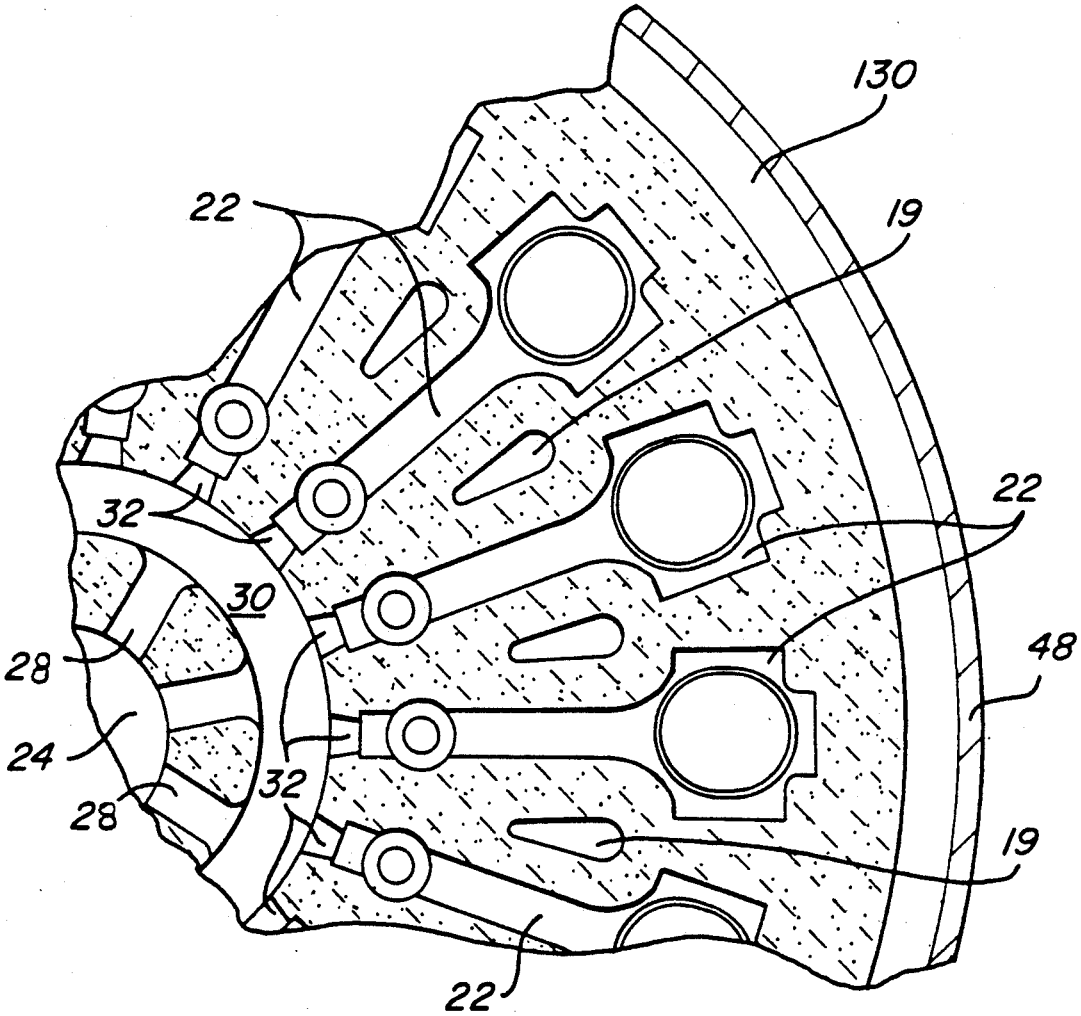
FIG. 2 is a fragmentary cross-sectional view of the casting mold taken along lines 2—2 of FIG. 1.

FIGS. 1 and 2 illustrate a vacuum assisted, countergravity casting apparatus in accordance with one embodiment of the invention. The apparatus includes a container 10 of melt 12 (e.g., molten metal) to be drawn up in to the gas permeable mold 14. The gas permeable mold 14 includes a gas permeable lower mold member 16 having a depending integral fill tube 17 adapted for immersion in the melt 12 and a plurality of gas permeable mold members 18 stacked atop the lower mold member 16 to define a plurality of generally horizontal parting planes P therebetween. The fill tube 17 may be integral to the bottom mold member 16 (as shown) or a separate tube attached thereto.

A plurality of mold cavities 22 are formed at each parting plane P and are communicated to a central, upstanding sprue 24 (defined by the mold members 16,18) via a respective ingate system 26 located at each parting plane P. As is apparent from FIG. 2, the mold cavities 22 are spaced apart circumferentially about the upstanding fill sprue 26 at each parting plane P. The fill sprue 24 includes an open lower end **24*a* adapted for immersion in the melt 12 and an upper end 24*b* closed off by the gas permeable topmost mold member 18**.

A plurality of upstanding vacuum access passages 19 (see FIG. 2) extend through the mold members 16,18 and are circumferentially spaced apart about the sprue 24 between the mold cavities 22 to facilitate access of subambient pressure to the mold cavities 22.

Each ingate system 26 includes a plurality of first ingates 28 connecting the sprue 24 to an ingate annulus 30 and a plurality of second ingates 32 connecting the ingate annulus 30 to a respective mold cavity 22. The first ingates 28 of each system 26 descend from the sprue 24 toward the mold cavities 22 proximate thereto for purposes to be explained hereinbelow.

The mold members 16,18 can be made of resin-bonded sand in accordance with known mold practice wherein a mixture of sand and bonding material is formed to shape and cured or hardened against a contoured metal pattern (not shown) having the desired complementary contour or profile for the parting planes P; i.e., the mold cavities 22 and the ingate systems 26. The bonding material is usually present in minor percentage, such as less than about 5% by weight of the mixture. After curing or hardening, the resin-bonded, self-supporting sand mold members 16,18 may optionally be adhesively secured together at the parting planes P.

Although the invention is advantageously used with the stacked, resin-bonded sand mold members 16,18 shown in FIG. 1, the invention is not so limited and may be used with other mold types such as one piece or multi-piece high temperature bonded ceramic molds; e.g., as shown in U.S. Pat. No. 4,112,997.

Referring to FIG. 1, the gas permeable mold 14 is shown sealingly received in a vacuum box 40 having a bottom portion **40*a* and a top portion 40*b* releasably sealed together at an annular resilient (rubber) seal 41. The bottom portion 40*b* includes an annular bottom support wall 42 and a peripheral side wall 43**.

The lower mold member 16 is sealingly supported on the support wall 42 via a heat resistant metal annular support collar 46 and an annular, refractory gasket 47. The collar 46 includes an annular, flat support surface **46*a* on which the mold members 16,18 are stacked such that they mate tightly together at the parting planes P. The collar 46 is sealed to the lower mold member 16 by an annular refractory gasket 45 and, as mentioned, is sealed to the bottom support wall 42 via the annular refractory gasket 47. The collar 46 is thermally protected from the heat of the melt 12 by an annular metal shield 50 fastened to the support wall 42 by a plurality of circumferentially spaced apart bolts (not shown). The shield 50 forms a thermally insulating air space 50*a* between the collar 46 and the shield 50** to this end.

The top portion **40*b* of the vacuum box 40 includes a peripheral wall 48 and a ceiling structure 49 overlying the top 14*a* of the mold 14. The ceiling structure comprises a horizontal plate 60 affixed as by welding to the peripheral wall 48 and an annular plate assembly 62 fastened on the plate 60 and sealed thereto via an annular resilient (rubber) seal 64. Plate assembly 62 includes an upper plate 62*a* and a side plate 62*b* that joins the upper plate 62*a* to the plate 60**.

The plate assembly 62 includes an opening 70 in upper plate **62*a* to accommodate a chamber-forming structure 80 and a mold-biasing structure 82 that are movable relative to the plate 60 and plate assembly 62. In particular, the mold-biasing structure 82 comprises a tubular body 84 suspended from the plate assembly 62 to overlie a peripheral portion of the mold top 14***a*. The body 84 is suspended from the plate assembly 62 by an annular flexible sleeve or wall 86 fastened therebetween. The sleeve 86 is fastened over raised elongated shoulders 88,90 disposed on the plate assembly 62 and the tubular body 84, respectively, for purposes to be explained below. A plurality of circumferentially, spaced apart pins 93 (two shown) are fastened (e.g., screwed) to the underside of the tubular body 84 and include enlarged lower heads 93*a* for bearing on a metal (e.g., steel) bearing plate 51 disposed atop the mold 14. As will be explained below, the mold-biasing structure 82 functions to bias the mold toward the vacuum box bottom support wall 42, thereby biasing members 16,18 together at the generally horizontal parting planes P.

The chamber-forming structure 80 overlies a central portion of the mold top 14*a* above the sprue 24. In particular, the chamber-forming structure 80 is suspended from an inwardly extending flange 94 of the tubular body 84 by an annular flexible sleeve or wall 96. The sleeve 96 is affixed to the flange 94 and to a horizontal plate 100 of the structure 80 so as to overlie raised elongated shoulders 102,104 thereon, respectively, for purposes to be explained below. An annular passage 110 is formed beneath the plate 100 by concentric, annular side panels 112,114 and bottom plate 116, FIG. 1. The side panel 112 includes a plurality of circumferentially spaced apertures 118 (two shown) that communicate the passage 110 to a first central chamber 120 surrounded thereby. As is apparent from FIG. 1, the first chamber 120 is disposed above the mold top 14*a* over the sprue 24 and is separated from the sprue 24 by the gas permeable (porous) wall 18*a* of the topmost mold member 18. An annular resilient (rubber) seal 124 is carried on the bottom plate 116 and sealingly engages the mold top 14*a* as shown to sealingly isolate the first chamber 120 from a second chamber 130 formed about the mold periphery 14*b* by the vacuum box 40.

The first chamber 120 is communicated by a commercially available pilot operated, or direct solenoid operated, valve means 140 to a source 134 of subambient pressure (e.g., a vacuum pump) or, alternately, to a pressure source 136 as shown in FIG. 1 via conduits 142,143,145. The pressure source 136 may simply comprise ambient (i.e., atmospheric) pressure exterior of the vacuum box 40. Alternately, the source 136 may comprise a conventional source of compressed gas maintained at a preselected pressure, for example, a pressure of 5 psi. The compressed gas may comprise air, a gas that is non-reactive with the melt 12 (e.g., an inert gas such as argon) or other gas suitable for use with the melt 12 being cast.

When the first chamber 120 is communicated to the subambient pressure source 134 via the valve means 140, subambient pressure will be applied to the first chamber 120 and to the mold fill sprue 24 through the gas permeable (porous) wall 18*a* of the topmost mold member 18. Alternately, when the first chamber 120 is communicated to the pressure source 136, increased pressure will be applied to the mold fill sprue 24 through the gas permeable wall 18*a*. The valve means 140 is thus operable to connect the first chamber 120 to either the vacuum source 134 or the pressure source 136.

The second chamber 130 is communicated to the source of subambient pressure by conduits 146 (shown schematically) extending from fittings 148 on the vacuum box wall 48. Those skilled in the art will appreciate that the second chamber 130 may be communicated to the same or different vacuum source 134 as the first chamber 120.

In practicing the present invention, the vacuum box 40 is initially in the open condition (i.e., the top portion 40*b* is separated from the bottom portion 40*a*). The mold 14 and the support collar 46 are first positioned on the vacuum box bottom wall 42 with the collar 46 sealingly engaged against the gasket 47 and with the fill tube 17 extending downwardly outside the vacuum box 40. Then, the top portion 40*b* of the vacuum box 40 is sealably secured by suitable clamps (not shown) on the bottom portion 40*a* (i.e., at seal 41) as shown in FIG. 1. When the vacuum box 40 is thusly assembled, the pins 93 of the mold-biasing structure 82 are placed in bearing relation on the bearing plate 51 and the seal 124 of the chamber-forming structure 80 contacts the mold top 14*a* as shown in FIG. 1.

The assembled vacuum box 40 with the mold 14 therein is positioned above the melt 12 and then lowered toward the melt 12 to immerse the open lower end 24*a* of the fill sprue 24 in the melt 12 as shown in FIG. 1. The vacuum box 40 is lowered (and raised), for example, by a hydraulic arm mechanism (not shown) of the type illustrated in U.S. Pat. No. 4,340,108.

Following immersion of the sprue open lower end 24*a* in the melt 12, the first chamber 120 and the second chamber 130 are then evacuated by communication to the source 134. The first chamber 120 is communicated to the source 134 by appropriate operation of the valve means 140. Evacuation of the first chamber 120 applies subambient pressure to the sprue 24 through the gas permeable mold top 14*a* (i.e., wall 18*a*) while evacuation of the second chamber 130 applies subambient pressure to the mold cavities 22 through the mold periphery 14*b*.

Evacuation of the second chamber 130 establishes a negative differential pressure across the sleeves 86,96 of the mold-biasing structure 82 and the chamber-forming structure 80 (i.e., between the sleeve outer sides which are exposed to ambient or atmospheric pressure and the sleeve inner sides which are communicated to the evacuated chamber 130 via apertures 132 in plate 60). This negative differential pressure causes the sleeves 86,96 to be pressed on the shoulders 88,90 and 102,104, respectively, such that the chamber-forming structure 80 and the mold-biasing structure 82 are biased toward the mold 14 to tightly engage the pins 93 against the bearing plate 51 and the seal 124 sealingly against the mold top 14*a*. This, in turn, presses the several mold members 18 tightly together at the generally horizontal mold parting planes P so as to eliminate the need to glue the several members together.

Figure 3:
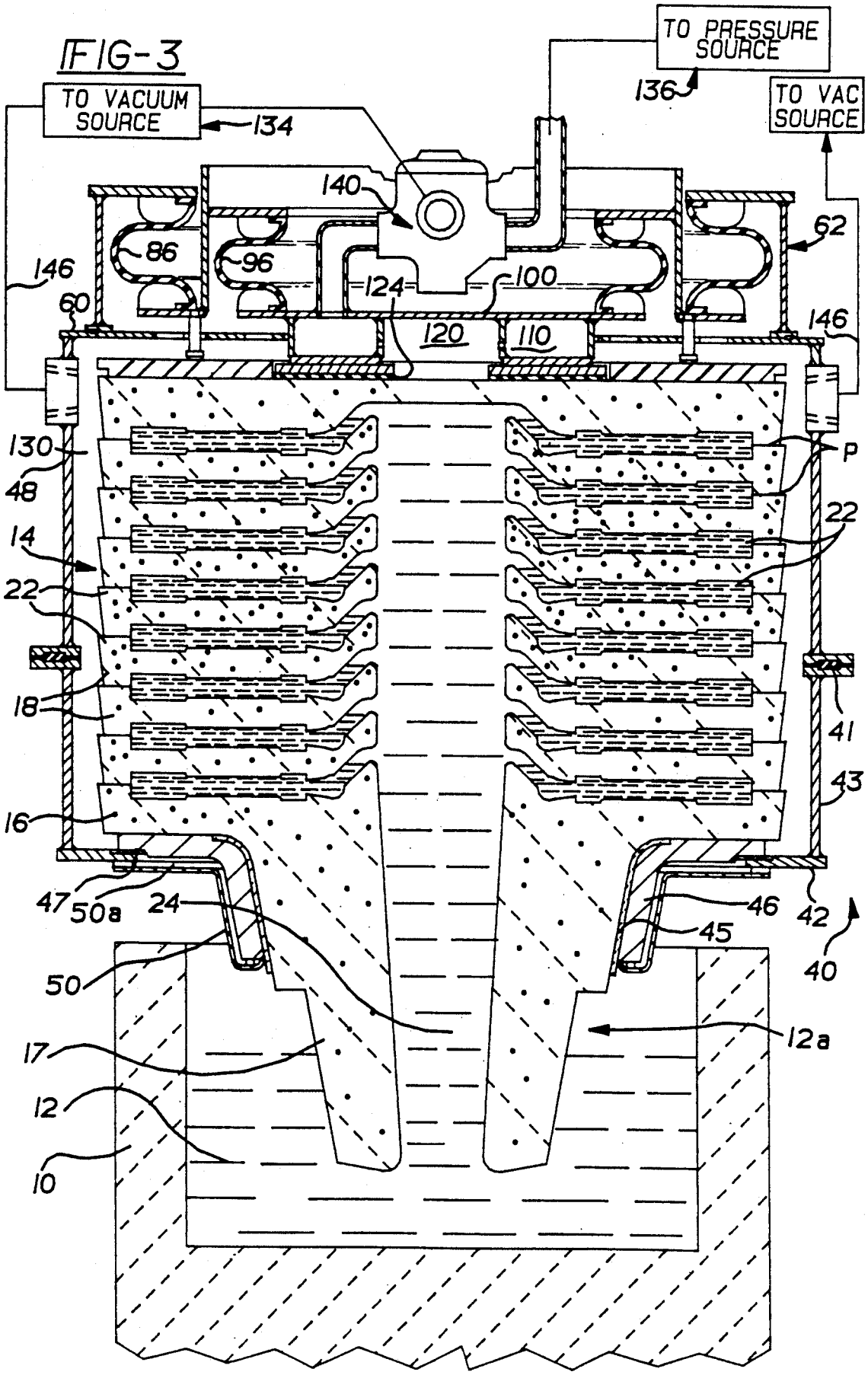
FIG. 3 is a sectioned, side elevational view similar to FIG. 1 showing the mold filled with the melt after casting.

The subambient pressure applied to the chambers 120,130 (by the source 134) and thus to the sprue 24 and the mold cavities 22 is sufficient to urge the melt 12 upwardly from the container 10 to fill the sprue 24 and the mold cavities 22 via the ingate systems 26 as shown in FIG. 3.

Although less preferred, the melt 12 can be drawn upwardly to fill the sprue 24 and the mold cavities 22 via the ingates 26 by evacuating only the second chamber 130 (i.e., it is possible to countergravity cast the melt 12 into the mold cavities 12 without evacuating the first chamber 120). In this situation, sufficient subambient pressure is applied to the mold fill sprue 24 and the mold cavities 22 by evacuation of the second chamber 130 alone to urge the melt upwardly into the fill sprue 24 and the mold cavities 22 via the ingate systems 26. Under these conditions, the valve means 140 is actuated to close off the first chamber 120 from the subambient pressure source 134 and the pressure source 136.

Figure 4:
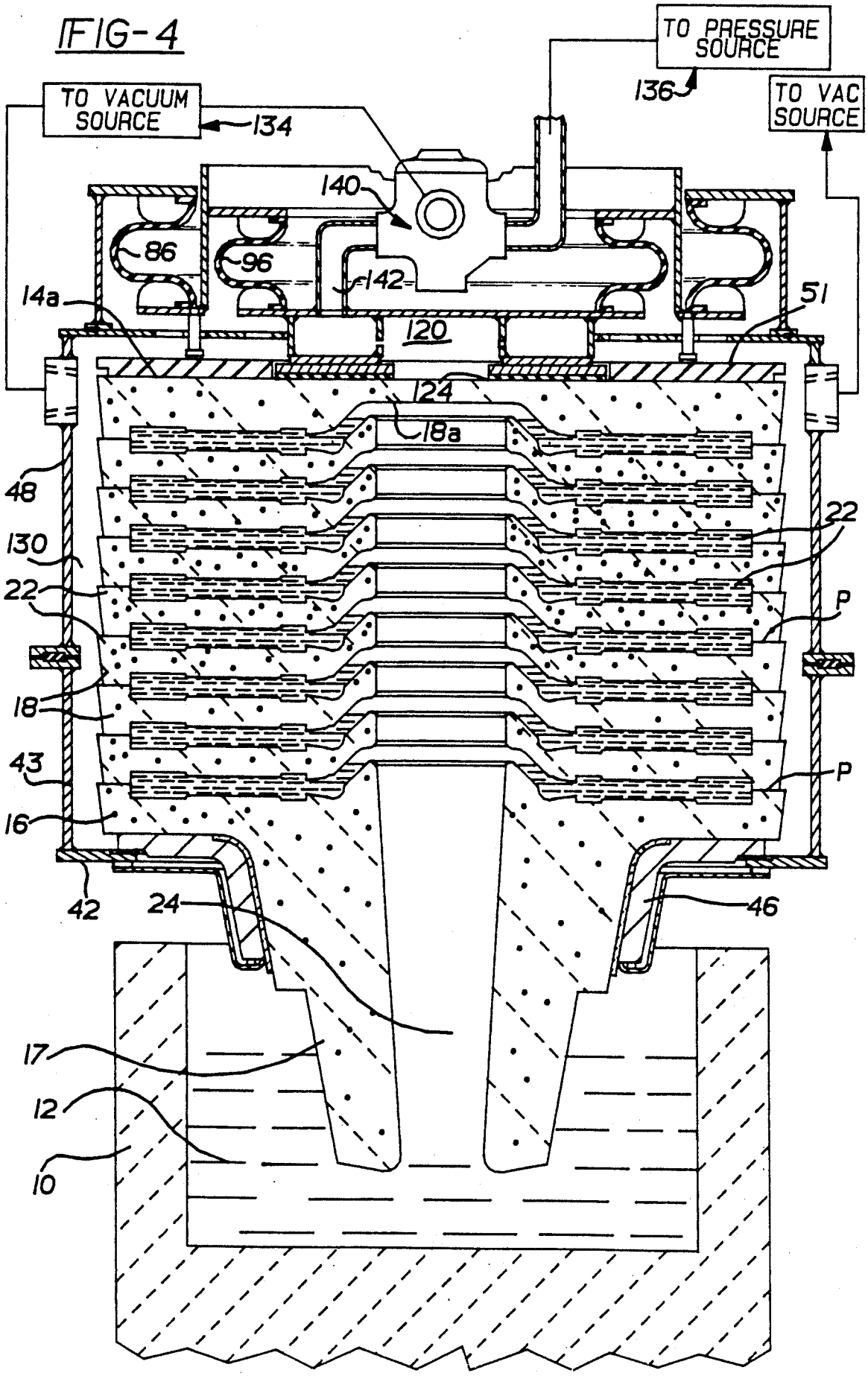
FIG. 4 is a sectioned, side elevation similar to FIG. 1 showing the melt drained from the mold fill sprue without siphoning the melt from the mold cavities.

After the mold cavities 22 are filled with the melt 12 (FIG. 3), the valve means 140 is actuated to communicate the first chamber 120 to the pressure source 136 while the second chamber 130 remains evacuated by the vacuum source 134. In this way, the pressure applied to the first chamber 120 and thus to the sprue 24 is selectively raised relative to the subambient pressure applied to the mold cavities 22. The positive differential pressure established by communicating the first chamber 120 to the pressure source 136 is sufficient to cause the melt 12 in the sprue 24 to drain downwardly out of the sprue lower open end 24*a* for return to the container 10 without siphoning the melt 12 in the mold cavities 22 therefrom (FIG. 4). As a result, the sprue 24 can be drained of melt 12 without adversely affecting the soundness of the castings formed in the mold cavities 22.

Following drainage of the melt 12 from the sprue 24, the vacuum box 40 and the mold 14 (having melt-filled mold cavities 22) is raised to withdraw the fill tube 17 out of the melt 12. The vacuum box 40 and the mold 14 are then transported to a demold station (not shown) where the vacuum box 40 and the mold 14 are separated. The vacuum box 40 can then be reused to cast another mold 14 as described hereinabove. The mold 14 can be disassembled to remove the solidified castings therefrom.

In accordance with another embodiment of the invention, as the vacuum box 40 and the mold 14 therein are initially lowered toward the melt 12 to immerse the fill tube 17 therein preparatory to casting, pressurized gas may be introduced into the first chamber 120 by actuating the valve means 140 to communicate the chamber 120 to the pressure source 136 which, as mentioned above, may comprise a conventional source of compressed gas such as, for example, air or inert gas. The pressurized gas introduced into the sprue 24 is discharged from the sprue lower open end 26*a* toward the surface region 12*a* of the melt 12 where the open lower end 24*a* will be immersed. The discharged gas impinges on the melt surface region 12*a* as the sprue open lower end 24*a* is immersed in the melt 12 so as to blow any slag, inclusions and other floating debris away from the surface region 12*a*, thereby reducing the amount of debris entering the mold 14 and ultimately the mold cavities 22 when the melt 12 is drawn upwardly thereinto during casting.

While the invention has been described in terms of specific embodiments thereof, it is not intended to be limited thereto but rather only to the extent set forth hereafter in the claims which follow.

I claim:

1. Apparatus for the vacuum-assisted, countergravity casting of a melt, comprising:

a) a gas permeable casting mold including an upstanding sprue having a lower open end for communicating with an underlying source of the melt, at least one mold cavity and a lateral ingate connecting the sprue and the mold cavity for supplying the melt from the sprue to the mold cavity, b) means for applying subambient pressure to the sprue when said lower open end and said source are communicated sufficient to urge the melt upwardly into the sprue, c) means for applying subambient pressure to the mold cavity when said lower open end and said source are communicated sufficient to urge the melt in the sprue to fill the mold cavity via the ingate, and d) means for selectively raising the pressure applied to the sprue after said mold cavity is filled with the melt, the pressure applied to the sprue being so raised relative to the subambient pressure applied to the mold cavity as to cause the melt in the sprue to drain through said lower open end for return to said source without siphoning of the melt from the melt-filled mold cavity.

2. The apparatus of claim 1 including valve means for alternately communicating the sprue to said means for applying subambient pressure thereto and to said means for selectively raising the pressure.

3. The apparatus of claim 2 wherein said valve means communicates the sprue to ambient pressure to selectively raise the pressure applied to said sprue.

4. The apparatus of claim 2 wherein said valve means communicates the sprue to a source of pressurized gas to selectively raise the pressure applied to said sprue.

5. The apparatus of claim 4 wherein the pressurized gas comprises compressed air.

6. The apparatus of claim 4 wherein the pressurized gas is non-reactive with the melt.

7. The apparatus of claim 1 wherein said lateral ingate descends from the sprue toward the mold cavity whereby siphoning of the melt from the mold cavity is resisted when the sprue is drained.

8. Apparatus for the vacuum-assisted countergravity casting of a melt, comprising:

a) a gas permeable casting mold including a bottom, a top and a side periphery therebetween, said mold including an upstanding sprue having a lower open end for communicating with an underlying source of melt, at least one mold cavity and a lateral ingate connecting the sprue and the mold cavity for supplying the melt from the sprue to the mold cavity, b) a first chamber confronting the top of the mold above the sprue, c) a second chamber confronting the side periphery of the mold, d) means for establishing subambient pressure in the first chamber when said lower open end and said source are communicated to apply sufficient subambient pressure to the sprue through the mold top to urge the melt upwardly to fill the sprue, e) means for establishing subambient pressure in the second chamber when said lower open end and said source are communicated to apply sufficient subambient pressure to the mold cavity through the mold periphery to urge the melt in the sprue to fill the mold cavity via the ingate, and f) means for selectively raising the pressure in the first chamber after said mold cavity is filled with the melt, the pressure in the first chamber being so raised relative to the subambient pressure in the second chamber as to cause the melt in the sprue to drain through said lower open end for return to said source without siphoning of the melt from the melt-filled mold cavity.

9. The apparatus of claim 8 including valve means for alternately communicating the first chamber to said means for establishing subambient pressure therein and to said means for selectively raising the pressure therein.

10. The apparatus of claim 9 wherein said valve means communicates the first chamber to ambient pressure to selectively raise the pressure in said first chamber.

11. The apparatus of claim 9 wherein the valve means communicates the first chamber to a source of pressurized gas to selectively raise the pressure in said first chamber.

12. The apparatus of claim 11 wherein the pressurized gas comprises compressed air.

13. The apparatus of claim 11 wherein the pressurized gas is non-reactive with the melt.

14. The apparatus of claim 8 wherein the first chamber is separated from an upper end of the sprue by a porous barrier.

15. The apparatus of claim 14 wherein the porous barrier comprises sand.

16. The apparatus of claim 14 wherein the porous barrier comprises the top of the mold.

17. The apparatus of claim 8 wherein said lateral ingate descends from the sprue toward the mold cavity whereby siphoning of the melt from the mold cavity is resisted when the sprue is drained.

18. The apparatus of claim 8 wherein said first chamber comprises a chamber-forming structure overlying a central portion of the mold top above the sprue for movement relative to said mold, said structure being biased on the mold top by a negative differential pressure thereacross when said subambient pressure is established in the second chamber.

19. The apparatus of claim 8 further comprising a mold-biasing structure overlying a peripheral portion of the mold top for movement relative to said mold, said mold-biasing structure being biased on the mold top by a negative differential pressure thereacross when said subambient pressure is established in the second chamber so as to bias the mold together at a horizontal mold parting plane.

20. The apparatus of claim 19 wherein the mold-biasing structure is disposed about a chamber-forming structure that defines said first chamber and overlies the mold top above the sprue, said chamber-forming structure being disposed above the mold top for movement relative thereto, said mold-biasing structure and said chamber-forming structure being biased on the mold top by a negative differential pressure thereacross when said subambient pressure is established in said first chamber and said second chamber.

21. The apparatus of claim 20 wherein the chamber-forming structure is suspended from the mold-biasing structure by a flexible wall interconnecting said mold-biasing structure and said chamber-forming structure.

22. A method of vacuum-assisted, countergravity casting of a melt, comprising the steps of:

a) providing a gas permeable casting mold having an upstanding sprue with a lower open end for communicating with an underlying source of the melt, at least one mold cavity and a lateral ingate connecting the sprue and the mold cavity for supplying the melt from the sprue to the mold cavity, b) applying subambient pressure to the sprue and the mold cavity when said lower open end and said source are communicated sufficient to urge the melt upwardly through the sprue and into the mold cavity via the ingate to fill said mold cavity with said melt, and c) selectively raising the pressure applied to the sprue after the mold cavity is filled with the melt, the pressure applied to the sprue being so raised relative to the subambient pressure applied to the mold cavity as to cause the melt in the sprue to drain through the open lower end for return to said source without siphoning of the melt from the melt-filled mold cavity.

23. The method of claim 22 wherein the pressure in the sprue is selectively raised by selectively communicating the sprue to ambient pressure.

24. The method of claim 22 wherein the pressure in the sprue is selectively raised by selectively communicating the sprue to a source of pressurized gas.

25. The method of claim 24 wherein the pressurized gas is non-reactive with the melt.

26. The method of claim 24 wherein the pressurized gas is compressed air.

27. The method of claim 22 including the additional step of introducing pressurized gas into the sprue as the mold and the source are relatively moved and discharging the gas from the lower open end toward the source to blow debris floating on the melt away from a region thereof where the lower open end and the source are to be placed in communication.

28. The method of claim 27 wherein the pressurized gas is compressed air.

29. The method of claim 27 wherein the pressurized gas is non-reactive with the melt.

30. The method of claim 22 further including relatively movably disposing a chamber-forming structure so as to overlie a central mold top portion above the sprue and evacuating the chamber of said chamber-forming structure to establish said subambient pressure in said sprue, including biasing said chamber-forming structure sealingly against the top mold portion by a negative differential pressure when subambient pressure is applied to the mold cavity.

31. The method of claim 30 including relatively movably disposing a mold-biasing structure about the chamber-forming structure so as to overlie a peripheral mold top portion and so as to be biased on the peripheral top mold portion by a negative differential pressure when the mold cavity is evacuated for biasing the mold together at a horizontal mold parting plane.

32. In a method of vacuum-assisted, countergravity casting of a melt, the steps comprising:

a) providing a gas permeable casting mold including an upstanding sprue having a lower open end for immersion in an underlying pool of melt, at least one mold cavity and a lateral ingate connecting the sprue and the mold cavity for supplying the melt from the sprue to the mold cavity, b) relatively moving the mold and the pool to immerse the lower open end in the melt at a surface region thereof, and c) introducing pressurized gas into the sprue as said mold and said pool are relatively moved so that the gas is discharged from said lower open end toward the melt to blow debris floating on the melt away from the surface region as said lower open end is immersed in the melt at said surface region.

33. The method of claim 32 wherein said pressurized gas is compressed air.

34. The method of claim 32 wherein said pressurized gas is non-reactive with the melt.

35. Apparatus for the vacuum-assisted, counter-gravity casting of a melt, comprising:

a) a gas permeable casting mold including an upstanding sprue having a lower open end for immersion in an underlying pool of melt, at least one mold cavity and a lateral ingate connecting the sprue and the mold cavity for supplying the melt from the sprue to the mold cavity, b) means for relatively moving the mold and the pool to immerse the lower open end in the melt at a surface region thereof, c) means for introducing pressurized gas into the sprue as the mold and the pool are relatively moved so that the gas is discharged from said lower open end toward the melt to blow debris floating on the melt away from the surface region as said lower open end is immersed in the melt, d) means for applying subambient pressure to the sprue when said lower open end is immersed in the melt sufficient to urge the melt upwardly to fill the sprue, e) means for applying subambient pressure to the mold cavity when said lower open end is immersed in the melt sufficient to urge the melt in the sprue to fill the mold cavity via the ingate, and f) means for selectively raising the pressure applied to the sprue after said mold cavity is filled with the melt, the pressure applied to the sprue being so raised relative to the subambient pressure applied to the mold cavity as to cause the melt in the sprue to drain through said lower open end for return to said pool without siphoning of the melt from the melt-filled mold cavity.

36. The apparatus of claim 35 wherein the pressurized gas is compressed air.

37. The apparatus of claim 35 wherein the pressurized gas is non-reactive with the melt.

* * * * *